US010231318B2

(12) United States Patent
Franciosa

(10) Patent No.: US 10,231,318 B2
(45) Date of Patent: Mar. 12, 2019

(54) METHOD AND SYSTEM FOR CONTROLLING THE SWITCHING ON OF LIGHTS

(71) Applicant: Marco Franciosa, Genova (IT)

(72) Inventor: Marco Franciosa, Genova (IT)

( * ) Notice: Subject to any disclaimer, the term of this patent is extended or adjusted under 35 U.S.C. 154(b) by 0 days.

(21) Appl. No.: 15/577,654

(22) PCT Filed: Dec. 30, 2016

(86) PCT No.: PCT/IB2016/058100
§ 371 (c)(1),
(2) Date: Nov. 28, 2017

(87) PCT Pub. No.: WO2017/115326
PCT Pub. Date: Jul. 6, 2017

(65) Prior Publication Data

US 2018/0295699 A1 Oct. 11, 2018

(30) Foreign Application Priority Data

Dec. 31, 2015 (IT) ..... UB2015A009817

(51) Int. Cl.
*H05B 33/08* (2006.01)
*H05B 37/02* (2006.01)

(52) U.S. Cl.
CPC ..... *H05B 37/029* (2013.01); *H05B 33/0842* (2013.01); *H05B 33/0863* (2013.01); *H05B 37/0272* (2013.01)

(58) Field of Classification Search
CPC ..... H05B 33/0803; H05B 33/0806; H05B 33/0809; H05B 33/0815; H05B 33/0821;
(Continued)

(56) References Cited

U.S. PATENT DOCUMENTS

2014/0091731 A1* 4/2014 Fushimi ..... H05B 37/0245 315/292
2014/0321859 A1* 10/2014 Guo ..... H04B 10/116 398/118

(Continued)

FOREIGN PATENT DOCUMENTS

WO 2014027275 2/2014

*Primary Examiner* — Alexander H Taningco
*Assistant Examiner* — Renan Luque
(74) *Attorney, Agent, or Firm* — Themis Law

(57) ABSTRACT

A lighting system having a plurality of lighting devices electrically connected thereto includes a control unit connected lighting devices and adapted to individually control the switching on of each lighting device according to a predetermined lighting program, and a user device adapted to communicate with the control unit and having a camera that acquires a sequence of images of the surrounding environment. The control unit implements a system configuration step that activates each lighting device according to a respective switching-on sequence, and the user device analyzes the sequence of images acquired during the system configuration step to determine the spatial position and/or identification code of each lighting device, and sends corresponding information to the control unit. The control unit is also adapted to implement a lighting program that considers the spatial positions of the lighting devices determined by the user device.

12 Claims, 3 Drawing Sheets

(58) Field of Classification Search
CPC ..... H05B 33/0827; H05B 33/0839; H05B 33/0842; H05B 33/0845; H05B 33/0857; H05B 33/0869; H05B 37/0245; H05B 37/0254; H05B 37/0263; H05B 37/0272; Y02B 20/346; Y10T 307/344; Y10T 307/615
See application file for complete search history.

(56) References Cited

U.S. PATENT DOCUMENTS

| | | | | |
|---|---|---|---|---|
| 2015/0102731 | A1 | 4/2015 | Altamura | |
| 2016/0270195 | A1* | 9/2016 | Ikehara ..... | H05B 37/0272 |
| 2017/0034468 | A1* | 2/2017 | Won ..... | H04N 5/4403 |

* cited by examiner

METHOD AND SYSTEM FOR CONTROLLING THE SWITCHING ON OF LIGHTS

TECHNICAL FIELD

The present invention relates to methods and systems for controlling lights, and it is preferably applied to the field of Christmas lights of the programmable type.

PRIOR ART

In prior art it is known to produce Christmas decorations with white or coloured lights that can be hung from balconies or put on the Christmas tree or on the Christmas crib.

Christmas decorations available nowadays in the market are of different types, from the simplest solutions, where lighting devices are switched all contemporaneously on or off, to the most complicated solutions where lighting devices, preferably composed of LEDs, can be programmed to be switched on according to different switching-on sequences.

A cheap and very widespread solution provides LEDs to be connected to a power supply able to individually control power to the individual LEDs.

An example of such solution is the Word Digital net by LuminalPark® that is programmed in factory to control LEDs such to display fixed or movable words. A remote controller is provided to the user with which he/she selects the different programs pre-set in factory.

More recently in the market also LEDs called as "addressable LEDs", "LED chips" or "LED pixels" are available which can be individually controlled by means of a communication bus. For example the integrated circuit WS2812 by WorldSemi® is able to receive input data and to send them as output for cascade connection of different chips and it controls a RGB LED (Red, Green, Blue) to which it is integrated.

Now in the market flexible light strips are available made with cascades of LED pixels that have, at one end, a connector for the connection to an external controller (for example Arduin®) by means of which the individual LED pixel can be individually controlled to obtain different light effects.

When using both normal LEDs and addressable LEDs, such light decorations have the common problem that the programming starts from the assumption that the lamps are placed according to a given spatial order. However when decoration is installed by the user the spatial order is not necessarily the one provided during the programming phase. For example think of a line of Led lights wound on a Christmas tree: they can be positioned as spirals or according to many different paths in the tree branches.

For another aim, from the patent application WO2014/027275 a system is known for controlling domestic appliances, for example lights or lamps, placed in an environment by means of a controlling apparatus, for example a smartphone. In one embodiment, the system provides to load one mobile app on the smartphone and to acquire images of an environment to associate areas of the screen to the different devices and to allow them to be controlled.

However such solution is applied to a distributed system, where, unlike what occurs for Christmas lights or LED strips, the addresses of the devices to be controlled and their relative positions can change.

OBJECTS AND SUMMARY OF THE INVENTION

It is the object of the present invention to overcome prior art drawbacks.

Particularly it is the object of the present invention to provide a method and a system for programming light effects considering the spatial position of the lights selected by the user.

These and other objects of the present invention are achieved by a method and a system according to the annexed independent claims and subclaims.

The general idea at the base of the invention is to determine the spatial position of lights such to determine the proper sequence with which they have to be switched on to realize a lighting program that provides lights to be switched on according to a predetermined spatial order, for example a program providing lights to be divided on three or more horizontal sections and that provides lights of each section to be switched on in sequence.

In one embodiment therefore the invention relates to a method for controlling switching on of lights emitted from a plurality of electrically connected lighting devices, for example LEDs of Christmas decoration, comprising the steps of:

- arranging the plurality of lighting devices in an environment,
- acquiring a sequence of images of the environment in which the plurality of lighting devices is disposed,
- during the acquisition of the sequence of images switching on the lighting devices of said plurality of lighting devices according to a different sequence, such to individually identify them (e.g. one at a time, or generally according to a specific time or color sequence of each device),
- analyzing the sequence of images to determine a spatial position of each lighting device in the environment,
- determining a sequence with which to switch on the lighting devices such that the lighting devices emit lights according to the lighting program, the lighting program providing to switch on lights according to a predetermined spatial order.

Advantageously the method of the present invention can control the switching on of the plurality of lighting devices according to the determined sequence.

Therefore such method allows drawbacks of prior art solutions to be overcome which provide Christmas decorations to be programmed in factory. After installing the lighting devices, for example a row of LEDs or a strip of addressable LEDs (or LED pixels) the user carries out a simple initial configuration step by acquiring a sequence of images (e.g. a video) of the environment where the lighting devices are arranged such to determine the spatial position thereof and to properly control them to achieve the desired light effect.

An object of the present invention is also a system comprising a plurality of lighting devices controlled by a control unit and a user device provided with a camera and able to communicate with the control unit. The control unit and the user device are configured to implement the steps of the method mentioned above and better described in the detailed description below. Particularly the control unit is adapted to receive a user input necessary to start the initial configuration step where the lighting devices are activated in a mode designed for individually locating them (e.g.: by being switched on one at a time), while the user device is configured to analyse a sequence of images, for example a video tape, and to determine the spatial position of the identified lighting devices, such to provide to the control unit data necessary for controlling the lighting devices such to obtain a desired lighting program.

Optional characteristics of the method and of the system of the invention are contained in the dependent annexed claims, that form an integral part of the present description.

BRIEF DESCRIPTION OF THE DRAWINGS

The invention will be described here below with reference to not limitative examples, provided by way of example and not as a limitation in the annexed drawings. These drawings show different aspects and embodiments of the invention and, where appropriate, reference numerals showing like structures, components, materials and/or elements in different figures are denoted by like reference numerals.

In the annexed figures.

DETAILED DESCRIPTION OF THE INVENTION

Figure 1:
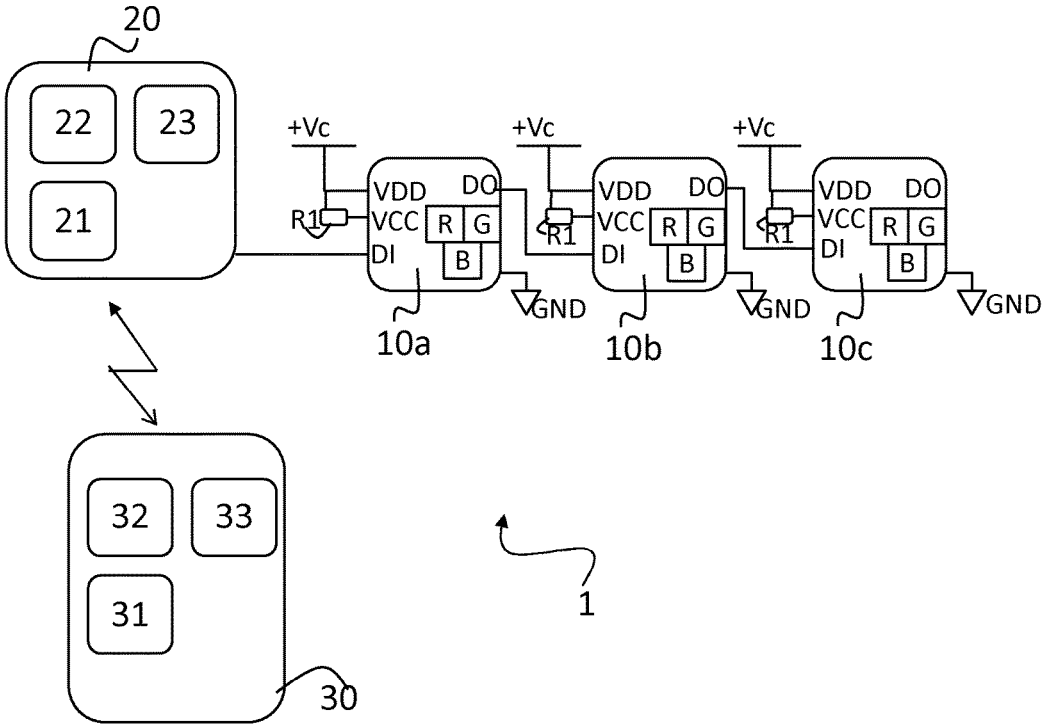
FIG. 1 is a lighting system according to the present invention.

While the invention is susceptible of various modifications and alternative constructions, some preferred embodiments are shown in the drawings and will be described in details herein below.

It should be understood, however, that there is no intention to limit the invention to the specific disclosed embodiment but, on the contrary, the invention intends to cover all the modifications, alternative constructions and equivalents that fall within the scope of the invention as defined in the claims.

The use of "for example", "etc.", "or" denotes non-exclusive alternatives without limitation, unless otherwise noted.

The use of "comprises" means "comprises, but not limited to", unless otherwise noted.

FIG. 1 shows a lighting system 1 according to one embodiment of the present invention.

The system 1 comprises a plurality of lighting devices 10*a*-10*c*, a control unit 20 and a user device 30.

In the not limitative example of FIG. 1, the lighting devices are three RGB LED Pixels (coloured, with Red, Green and Blue being separately switched on) equipped with an integrated control circuit WS2812.

Each lighting device is connected to a supply voltage +Vc of 5V from which it obtains a supply voltage VDD for the three colors (R,G,B), and a voltage VCC for control circuits. In the example of FIG. 1, a resistor R1, for example 150 Ohm resistor, is placed in series at the input VCC to generate the necessary voltage drop with respect to Vc, possible overvoltage protections or protections for electromagnetic noises may be provided as input at VCC.

Each lighting device 10*a*-10*c* receives control data at the input Data In (DI) and it transmits them as output at the output Data Out (DO). Based on the received control data, each lighting device controls the three colors RGB such to emit a light of the desired color at the desired moment.

In details, each lighting device is configured for responding to control messages that comprise control data and an identification code of the lighting device. In the example of FIG. 1 the output DO of the last lighting device 10*c* is not connected to the control unit 20, however such connection can be provided.

An example of a circuit solution for the connection of different LED pixels with integrated circuits WS2812 is shown in the datasheet of the same component.

Figure 2:
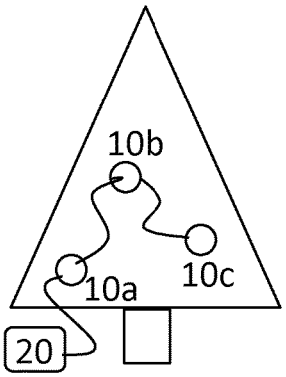
FIG. 2 is an environment where the system of FIG. 1 is installed.

The control unit 20 comprises a processor 21 generating control data for the lighting devices 10*a*-10*c* and a wireless module 22, e.g. Wi-Fi and/or Bluetooth, to communicate with a user device 30. The latter for example a smartphone or a tablet, is provided with a camera 31 and with a memory area 32 wherein code portions are stored, which, when executed, allow software functions to be implemented that are described below in order to control the lighting devices 10*a*-10*c*. Operatively, the user installs the lighting devices 10*a*-10*c* in the desired position, for example he/she puts them around the branches of a Christmas tree such as shown in FIG. 2.

Then the user desiring to run a lighting program (created by him/her or stored in a memory area of the user device or control unit), positions himself/herself in front of the lighting devices 10*a*-10*c* to record them with the camera 31 of the user device 30.

By means of a user interface 33 (e.g. keyboard or display touch) of the user device 30, the user starts a software application to configure the system 1.

Figure 3:
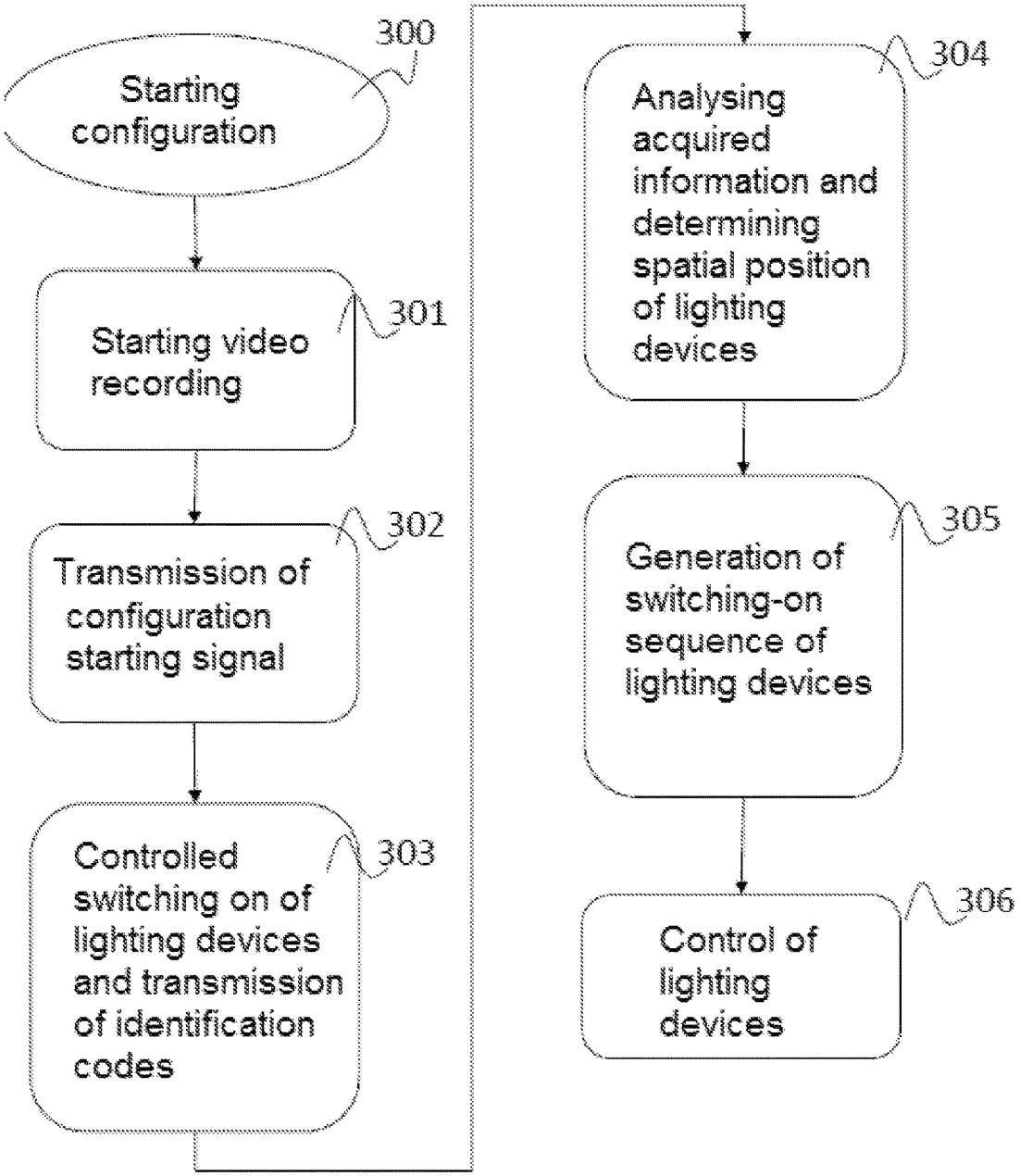
FIG. 3 is a method for controlling the switching on of lights emitted from a plurality of lighting devices in a system of the type of FIG. 1.

At the start of the application (step 300 of the method shown in FIG. 3) the user device 30 starts to record with the camera 31 (step 301) and it transmits (step 302) a configuration start signal to the control unit 20.

The control unit 20 (step 303) switches on all the lighting devices one at a time, maintaining switched on only one lighting device at a time, such that only one light is visible at a time, and it contemporaneously transmits to the user device 30, by the wireless module 22, the identification code of the lighting device actually switched on.

Once all the lighting devices have been switched on and off, the control unit 20 warns the user device 30 about the end of the switching-on sequence.

Now, the user device 30 ends the video recording of the camera and it analyses the recorded video together with information received from the control unit 20, about the identification codes of each lighting device. In details, the user device analyses the video to determine the position of the lighting devices that have been switched on.

In one embodiment, in order to determine the position of the installed lighting devices, the user device 30 calculates, for each frame of the video signal, the luminance of each pixel and it compares it with the luminance of the same pixel measured at the previous frame. If the luminance increases beyond a specific predetermined threshold value, then such increase is associated to one of the LEDs of the lighting devices being switched on.

As an alternative or in combination with the method mentioned above, in order to determine the presence of a light it is possible to detect the saturation of pixel values. When a pixel saturates, then a light generated from one of the lighting devices is considered to be present.

For instance let us suppose that the user device determines an increase of luminance (or a saturation) of a group of pixels of the pixel matrix composing the analysed image, for example let us suppose that it determines an increase of luminance (or saturation) of pixels (0,0), (0,1), (0,2), (1,0), (1,1), (1,2), (2,0), (2,1), (2,2). In this case the user device finds the position of the lighting device in the mean position of the pixels that exhibited an increase in luminance (or saturation), therefore position (1,1). At the end of video analysis, the user device 30 therefore is aware of the spatial arrangement of the lighting devices, at least it is aware of the relative position with respect to the recording point, and of their identification code and it can give information to the control unit that will control the lighting devices according to a program selected by the user.

For example let us suppose that the user selects, through the user interface 33, a lighting program that divides lights in two horizontal groups that are switched on in sequence (firstly the light of the lower group, and then the ones of the upper group) and suppose that lighting devices are arranged as in FIG. 2.

The user device, by analysing the acquired video, will place the lighting devices 10*a* and 10*c* in the lower group and the device 10*b* in the upper group.

The user device 30 therefore transmits to the control unit 20 information necessary to control the lighting devices to obtain the desired light effect. For example it will inform the control unit to contemporaneously switch on the lighting devices that have been activated as first and as third (10*a* and 10*c*) and to maintain them switched on for a given time interval, then these devices will be switched off and the lighting device (10*b*) that has been activated as second will be switched on.

In one embodiment, the control unit 20 stores in a memory area 23 a plurality of software programs that, when executed, allow the lighting devices to be controlled according to predetermined sequences.

In this embodiment, the user device 30 transmits to the control unit 20 new software programs, generated on the basis of the specific detected position of the lighting devices, that are stored in the memory area 23 such to be activated alternatively to the predetermined ones, creating customized light effects. Thus the user can activate lighting programs programmed by himself/herself by simply acting on the control unit, without the need of using each time the user device 30. Now it is clear that many variants can be made to the embodiment described above with reference to FIGS. 1-3.

Figure 4:
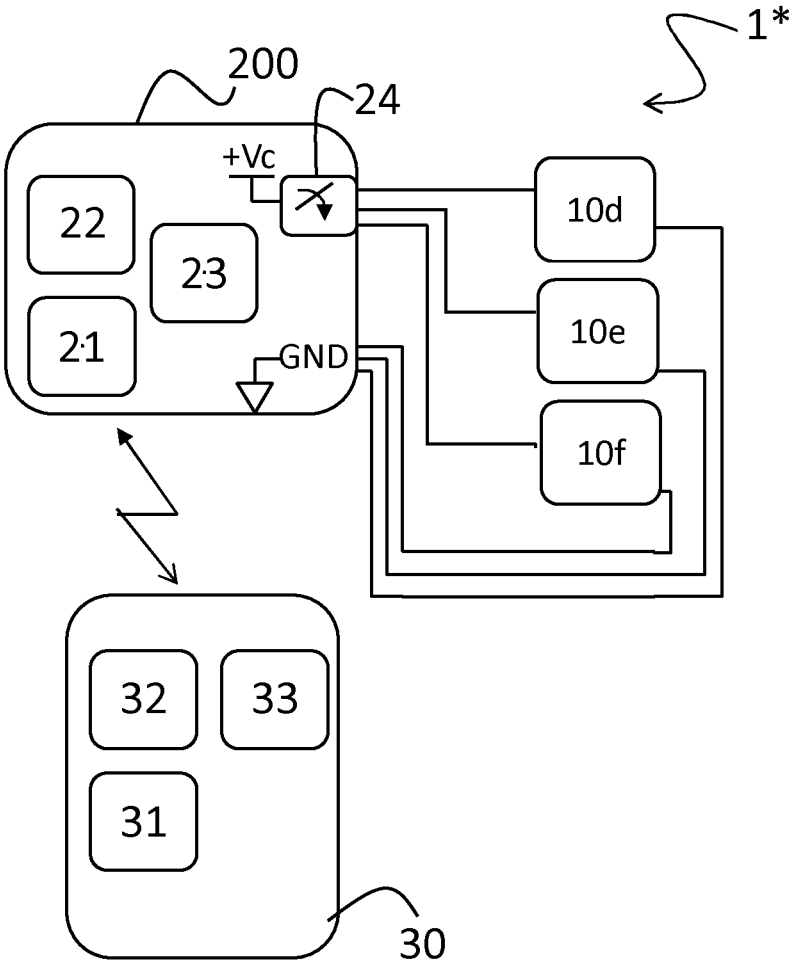
FIG. 4 is a variant of the system of FIG. 1.

For example FIG. 4 shows a variant of the system of FIG. 1, wherein the lighting devices are composed of monochromatic LEDs (10*d*-10*f*) that are selectively connectable to a supply line +Vc by a suitable switch system 24 controlled by the control unit 200.

During the configuration of the system 1* of FIG. 4, the control unit 200 switches on the LEDs 10*d*-10*f* in sequence by connecting them one by one to the power supply, while the user device 30 records the position thereof as described above with reference to the example of FIGS. 1 and 3.

Then the control unit 200 controls the switching on of LEDs 10*d*-10*e* based of information received from the user device 30 to make a lighting program dependent from the spatial position of the lights recorded by the user device 30.

Although in the example described above the user device records a video of the environment where the lighting devices are arranged to record their position, in a variant the method provides the user to take a photo of the environment before switching on the lighting devices and then to take other photos each time the control unit switches on one of the lighting devices.

In this embodiment, the user device determines the position of the lighting devices by searching for saturated pixel values or by comparing the images acquired when switching on the image devices with the one acquired with the devices in the switched off condition.

Unlike the embodiment described above that provides wireless transmission of an identification code of the lighting device that is switched on, in a variant such information is stored in the switching-on sequence of the lighting devices. For example the control unit 20, during the configuration step, switches on contemporaneously all the devices, and it provides for each of them a specific coded intermittence by means of which the user device 30 is able to detect, together with the spatial position, the identification code of each device. For example by supposing to identify each lighting device with a binary coding, for example 4 bit one, the control unit will switch on and off LEDs of the lighting devices during the several periods of a clock signal, such to reproduce the binary code that identifies the device. For example the LED 1001 will be switched on during the first clock period, it will be kept switched off for the two consecutive clock periods (bit 0) and then it will be switched on in the fourth clock period.

Therefore generally during the configuration step the lighting devices are switched on according to a specific sequence of each lighting device. Also in the example described above with reference to FIG. 3, lighting devices are switched on according to a different sequence: the first one is switched on immediately and then it remains switched off for the whole configuration step, the second one at first is switched off and then switched on and then again switched off till the end of the configuration and so on the others follow a different switching-on sequence. The same result of identifying the lighting devices by the switching-on sequence can be obtained by controlling the devices such that they are switched on by emitting lights with different colors.

For example each lighting device can be intended to emit light with different colors such that during the acquisition of the plurality of images, each device is controlled to generate a specific color sequence, said specific color sequence being associated to the identification code of the lighting device implementing it.

With the aim of minimizing the number of images to be acquired to determine the position and identification code of all the lighting devices, it is possible to adopt a sequence of N switching-on configurations calculated as it follows. If L is the number of lighting devices, and S is the number of distinguishable different states that each device can exhibit, then N is the smallest integer number that meets equation $S^N >= L$.

For example let us suppose to have 100 lighting devices and two states (e.g. switched on or off), then the number N of switching-on configurations necessary to identify the device position is equal to 7, since $2^7=128>=100$, while $2^6=64<100$.

Operatively, in this example, each device is identified with a number 1 that changes from 0 to L-1; each state s is numbered from 0 to S-1; and each switching-on configuration is numbered from 0 to N-1.

In each i-th switching-on configuration, each device is controlled such to exhibit the state s[j] where j is the i-th number of 1 represented in base S.

Still in the above example:

the first device (l=0) will exhibit a state s[0] in all the 7 switching-on configurations.

The second device (l=1) will exhibit a state s[1] in the first switching-on configuration and a state s[0] in all the remaining 6 switching-on configurations.

The third device, since l=2 is represented in base 2 (since S=2) as 10, then it will have a state s[0] in the first switching-on configuration, a state s[1] in the second switching-on configuration, and a state s[0] in the remaining 5 switching-on configurations.

It is clear how the term "switching-on configuration" means an image, a scene, wherein each LED has a specific lighting state. It is also clear that the method for controlling lighting devices described above can be implemented by distributing the several functions among different devices in a manner different from the above. For example, the lighting programs can be stored in a memory area of the user device or can be retrieved from other devices, for example web servers connected to Internet to which the user device or the control unit can access.

The several functions of the devices described above with reference to some blocks, can be joined or distributed in a different manner.

The invention claimed is:

1. A method for controlling a switching on of lights emitted from a plurality of lighting devices which are electrically connected, comprising:

arranging the plurality of lighting devices in an environment;

acquiring a sequence of images of the environment in which the plurality of lighting devices is disposed;

during acquisition of the sequence of images, switching on each lighting device according to a different sequence, wherein said sequence allows each lighting device to be uniquely identified;

analyzing the sequence of images to determine a spatial position of each lighting device in the environment; and determining a sequence, with which to switch on the lighting devices, so as to cause the lighting devices to emit lights according to a lighting program, said lighting program causing the switching on of the lights according to a predetermined spatial order, wherein at least N images of the lighting devices are acquired, where N is the smallest integer number that meets an equation $$S^N>=L,$$

with L being a number of the lighting devices and S a number of distinguishable states that can be taken by each lighting device.

2. The method according to claim 1, wherein each lighting device is configured to respond to control messages comprising an identification code of the lighting device, wherein the analyzing said sequence of images comprises analyzing said sequence of images to determine the spatial position and the identification code of each lighting device;

further comprising the step, once the spatial position and the identification code of each lighting device are determined, of selecting the lighting program and sending control messages to control the lighting devices according to a sequence that considers the determined spatial position.

3. The method according to claim 1, wherein the sequence of images is a sequence of frames of a video.

4. The method according to claim 1, wherein each lighting device has a number k that changes from 0 to L-1, and wherein at each i-th image, each device takes a state s[j], where j is the i-th number of k represented in S.

5. The method according to claim 1, wherein during the acquisition of the sequence of images, each lighting device switches on and off according to a time sequence representing an identification binary code of each lighting device.

6. The method according to claim 1, wherein the lighting program is selected from among a plurality of lighting programs.

7. The method according to claim 1, wherein the lighting program is set by a user using a user device operatively connected to a control unit adapted to control the switching on of the plurality of lighting devices.

8. The method according to claim 1, wherein each lighting device is adapted to emit light of different colors, and wherein during the acquisition of the sequence of images, each device is controlled to generate a specific color sequence, the specific color sequence being associated to an identification code of the lighting device implementing the specific color sequence.

9. A lighting system comprising:

a plurality of lighting devices that are electrically connected and adapted to emit light;

a control unit connected to the plurality of lighting devices and adapted to individually control a switching on of each of the lighting devices in accordance with a predetermined lighting program; and a user device adapted to communicate with the control unit and comprising a camera to acquire a sequence of images of an environment in which the plurality of lighting devices is disposed, wherein the control unit is configured to implement a system configuration step that activates each lighting device according to a respective switching-on sequence, wherein the user device is configured for:

analyzing the sequence of images acquired during the system configuration step to determine one or both of a spatial position or an identification code of each lighting device in the environment, and sending information to the control unit about the spatial position and the identification code of each lighting device, wherein the control unit is configured to implement a lighting program that considers the spatial positions of the lighting devices determined by the user device, and wherein, during the system configuration step, the user device is configured to acquire at least N images, where N is the smallest integer number that meets an equation $$S^N>=L,$$

with L being a number of the lighting devices and S a number of distinguishable states that can be taken by each lighting device.

10. The lighting system according to claim 9, wherein each lighting device has a number k that changes from 0 to L-1, and wherein at each i-th image, the control unit controls each lighting device such that the lighting device takes a state s[j], where j is the i-th number of k represented in S.

11. The lighting system according to claim 9, wherein, during the configuration step, the control unit switches on and off each lighting device according to a time sequence representing an identification binary code of said each lighting device.

12. The lighting system according to claim 9, wherein each lighting device is adapted to emit light in different colors, and wherein during the configuration step the control unit controls each lighting device to generate a specific color sequence, the specific color sequence being associated to the identification code of the lighting device implementing the specific color sequence.

* * * * *